US009642421B2

(12) United States Patent
Ma

(10) Patent No.: US 9,642,421 B2
(45) Date of Patent: May 9, 2017

(54) UMBRELLA CANOPY TILT MECHANISM

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 0 days.

(21) Appl. No.: 13/802,238

(22) Filed: Mar. 13, 2013

(65) Prior Publication Data

US 2013/0333734 A1 Dec. 19, 2013

(30) Foreign Application Priority Data

Jun. 18, 2012 (CN) ..... 2012 2 0292694 U

(51) Int. Cl.
*A45B 17/00* (2006.01)
*A45B 23/00* (2006.01)

(52) U.S. Cl.
CPC ..... *A45B 17/00* (2013.01); *A45B 23/00* (2013.01); *A45B 2023/0037* (2013.01); *A45B 2023/0081* (2013.01)

(58) Field of Classification Search
CPC .... A45B 2023/0031; A45B 2023/0037; A45B 2023/0081; A45B 17/00
USPC ..... 135/20.1, 20.3, 21
See application file for complete search history.

(56) References Cited

U.S. PATENT DOCUMENTS 2,183,833 A 12/1939 Farhar
2,235,518 A 3/1941 Goshaw
2,475,406 A 7/1949 Russell
2,661,752 A 12/1953 Kampf et al.
2,670,133 A 2/1954 Volker
2,721,569 A 10/1955 Militano
2,724,396 A 11/1955 Pereira
2,905,187 A 9/1959 Croce
(Continued)

FOREIGN PATENT DOCUMENTS

CN 2419864 Y 2/2001
CN 2441342 Y 8/2001
(Continued)

OTHER PUBLICATIONS

U.S. Appl. No. 13/797,156 and its prosecution history, Mar. 12, 2013, Ma.
(Continued)

*Primary Examiner* — David R Dunn
*Assistant Examiner* — Danielle Jackson
(74) *Attorney, Agent, or Firm* — Knobbe, Martens, Olson & Bear, LLP

(57) ABSTRACT

In some embodiments, an umbrella canopy tilt mechanism is provided that can include a crank mechanism and an automatic bending mechanism. The crank mechanism includes a crank and a rope. The crank is configured to be swivel-mounted on one end of the curved cantilever of a sunshade umbrella. The automatic bending mechanism is configured to be installed in a shaft of the sunshade umbrella. One end of the rope is configured to connect to the crank. The other end of the rope is configured to extend along the curved cantilever to reach the other end of the curved cantilever. The rope is configured to extend through the shaft and automatic bending mechanism to connect to a lower runner. The lower runner is held and slides on the shaft. An upper runner is fixedly secured to the shaft. The umbrella canopy tilt mechanism can further be provided with a rotation mechanism.

35 Claims, 8 Drawing Sheets

(56) References Cited

U.S. PATENT DOCUMENTS

| | | | | |
|---|---|---|---|---|
| 2,914,154 | A | 11/1959 | Russell | |
| 3,120,238 | A | 2/1964 | Glatz | |
| 3,129,715 | A | 4/1964 | Fleischer et al. | |
| 3,142,307 | A | 7/1964 | Danciart et al. | |
| 3,145,720 | A | 8/1964 | Torii | |
| 3,150,671 | A | 9/1964 | Frey | |
| 3,175,568 | A | 3/1965 | Kafka | |
| 3,182,673 | A | 5/1965 | Small | |
| 3,486,514 | A | 12/1969 | Prescott | |
| 3,765,434 | A | 10/1973 | Riggs | |
| 3,926,202 | A | 12/1975 | Uthemann et al. | |
| 4,148,164 | A | 4/1979 | Humphrey | |
| 4,582,078 | A | 4/1986 | Ma | |
| 4,586,525 | A | 5/1986 | Glatz et al. | |
| 4,606,366 | A | 8/1986 | Collet | |
| 4,622,987 | A | 11/1986 | Redl et al. | |
| 4,674,523 | A | 6/1987 | Glatz | |
| 4,697,606 | A | 10/1987 | Ma | |
| 4,878,509 | A | 11/1989 | Tung | |
| 5,002,081 | A | 3/1991 | Stromeyers | |
| 5,029,596 | A | 7/1991 | Tung | |
| 5,086,797 | A | 2/1992 | Earnshaw et al. | |
| 5,116,258 | A | 5/1992 | Vennik | |
| 5,156,395 | A | 10/1992 | Smith | |
| 5,161,764 | A | 11/1992 | Roney | |
| 5,349,975 | A | 9/1994 | Valdner | |
| 5,437,297 | A | 8/1995 | Crisman et al. | |
| 5,492,232 | A | 2/1996 | Ohm | |
| 5,499,644 | A | 3/1996 | Geniele | |
| 5,584,564 | A | 12/1996 | Phyle | |
| 5,611,364 | A | 3/1997 | Woods et al. | |
| 5,678,585 | A | 10/1997 | May | |
| 5,711,333 | A | 1/1998 | Vanderminden, Sr. | |
| 5,735,302 | A | 4/1998 | Saliva | |
| 5,785,069 | A | 7/1998 | Glatz | |
| D398,443 | S | 9/1998 | Bolle | |
| 5,845,665 | A | 12/1998 | Koehn | |
| 5,868,152 | A | 2/1999 | Brown | |
| 5,871,024 | A | 2/1999 | Vanderminden, Sr. | |
| 5,937,882 | A | 8/1999 | Harbaugh | |
| 5,960,806 | A | 10/1999 | Steiner | |
| 6,014,980 | A | 1/2000 | Glatz | |
| D434,215 | S | 11/2000 | Lin | |
| 6,152,156 | A | 11/2000 | Tung | |
| D434,556 | S | 12/2000 | Lin | |
| 6,196,244 | B1 | 3/2001 | Haddad et al. | |
| 6,209,147 | B1 | 4/2001 | Wheaton | |
| 6,220,261 | B1 | 4/2001 | Glatz | |
| 6,311,705 | B1 | 11/2001 | Ma | |
| 6,330,886 | B1 | 12/2001 | Culver | |
| 6,435,444 | B1 | 8/2002 | Lin | |
| 6,446,650 | B1 | 9/2002 | Ma | |
| 6,478,037 | B2 | 11/2002 | Tung | |
| 6,520,192 | B1 | 2/2003 | Lo | |
| 6,571,403 | B2 | 6/2003 | Wheaton | |
| 6,575,182 | B2 | 6/2003 | Tung | |
| 6,575,183 | B2 | 6/2003 | Tung | |
| D477,458 | S | 7/2003 | Goldwitz | |
| 6,588,438 | B1 | 7/2003 | Steiner | |
| 6,607,002 | B2 | 8/2003 | Reese | |
| 6,619,306 | B2 | 9/2003 | Ma | |
| 6,662,815 | B2 | 12/2003 | Tung | |
| 6,761,180 | B1 | 7/2004 | Lai | |
| D497,479 | S | 10/2004 | Yu | |
| 6,827,094 | B1 | 12/2004 | Bramwells | |
| 6,837,255 | B2 | 1/2005 | Bunch et al. | |
| 6,840,253 | B2 | 1/2005 | Ma | |
| 6,851,823 | B2 | 2/2005 | Bilotti | |
| 6,923,193 | B2 | 8/2005 | Chen | |
| 6,926,019 | B2 | 8/2005 | Glatz | |
| 6,945,263 | B2 | 9/2005 | Li | |
| 6,953,043 | B2 | 10/2005 | Yu | |
| 6,988,504 | B1 | 1/2006 | Goldwitz | |
| D518,629 | S | 4/2006 | Ma | |
| 7,108,388 | B2 | 9/2006 | Li | |
| 7,134,442 | B2 | 11/2006 | Ma | |
| 7,156,114 | B2 * | 1/2007 | Lo | 135/21 |
| 7,207,343 | B2 | 4/2007 | Earnshaw et al. | |
| 7,255,118 | B2 | 8/2007 | Vardy et al. | |
| 7,341,068 | B2 | 3/2008 | Liu | |
| 7,398,790 | B2 | 7/2008 | Glatz | |
| 7,412,985 | B2 | 8/2008 | Ma | |
| 7,493,909 | B2 | 2/2009 | Ma | |
| 7,520,289 | B1 | 4/2009 | Barber | |
| 7,533,680 | B2 | 5/2009 | Ma | |
| 7,556,051 | B2 | 7/2009 | Lai | |
| 7,708,022 | B2 * | 5/2010 | Joen-an Ma | 135/20.1 |
| 7,717,121 | B2 | 5/2010 | Glatz | |
| D621,600 | S | 8/2010 | He | |
| 7,866,331 | B2 | 1/2011 | Glatz | |
| 7,886,755 | B2 | 2/2011 | Tung | |
| 7,913,707 | B2 | 3/2011 | Lai | |
| 7,918,054 | B2 | 4/2011 | Grafton | |
| D638,622 | S | 5/2011 | He | |
| 7,980,261 | B2 | 7/2011 | Glatz | |
| 8,066,021 | B2 * | 11/2011 | Ma | A45B 23/00 135/20.1 |
| 8,104,492 | B2 | 1/2012 | Dan | |
| 8,113,223 | B2 | 2/2012 | Wang et al. | |
| 8,360,080 | B2 | 1/2013 | Liu et al. | |
| 8,522,804 | B1 * | 9/2013 | Tung | 135/20.1 |
| 9,220,325 | B2 | 12/2015 | Ma | |
| 9,237,785 | B2 | 1/2016 | Ma | |
| 9,289,038 | B2 | 3/2016 | Ma | |
| 2002/0083969 | A1 | 7/2002 | Tung | |
| 2002/0104557 | A1 | 8/2002 | Tung | |
| 2002/0129847 | A1 | 9/2002 | Ma | |
| 2002/0174887 | A1 | 11/2002 | Reese | |
| 2003/0010366 | A1 | 1/2003 | Glatz | |
| 2003/0015230 | A1 | 1/2003 | Glatz | |
| 2004/0031513 | A1 | 2/2004 | Bunch et al. | |
| 2004/0055627 | A1 | 3/2004 | Moga | |
| 2004/0055628 | A1 | 3/2004 | Yu | |
| 2004/0069333 | A1 | 4/2004 | Ma | |
| 2004/0177871 | A1 | 9/2004 | Harbaugh | |
| 2004/0182429 | A1 | 9/2004 | Chen | |
| 2004/0261827 | A1 | 12/2004 | Chen | |
| 2005/0013130 | A1 | 1/2005 | Li | |
| 2005/0016571 | A1 | 1/2005 | Wu | |
| 2005/0028852 | A1 | 2/2005 | Reese | |
| 2005/0041425 | A1 | 2/2005 | Li | |
| 2005/0229957 | A1 | 10/2005 | Glatz | |
| 2005/0268952 | A1 | 12/2005 | Ma | |
| 2005/0268953 | A1 | 12/2005 | Ma | |
| 2006/0081277 | A1 | 4/2006 | Liu | |
| 2006/0169307 | A1 | 8/2006 | Lo | |
| 2006/0201542 | A1 | 9/2006 | Ma | |
| 2006/0243311 | A1 | 11/2006 | Glatz | |
| 2006/0278262 | A1 | 12/2006 | Ma | |
| 2007/0074751 | A1 | 4/2007 | Fraser | |
| 2007/0163632 | A1 | 7/2007 | Chang | |
| 2007/0209688 | A1 | 9/2007 | Earnshaw | |
| 2008/0236640 | A1 | 10/2008 | Huali | |
| 2010/0051074 | A1 | 3/2010 | Dan | |
| 2010/0101614 | A1 | 4/2010 | Wang et al. | |
| 2010/0192997 | A1 * | 8/2010 | Liu et al. | 135/20.1 |
| 2010/0212705 | A1 | 8/2010 | Tung | |
| 2011/0005558 | A1 | 1/2011 | Lai | |
| 2013/0092200 | A1 | 4/2013 | May | |
| 2014/0158173 | A1 | 6/2014 | Li et al. | |
| 2014/0166060 | A1 | 6/2014 | Ma | |
| 2014/0311537 | A1 | 10/2014 | Ma | |
| 2015/0059815 | A1 | 3/2015 | Xiong | |
| 2015/0068567 | A1 | 3/2015 | Ma | |
| 2016/0183647 | A1 | 6/2016 | Ma | |

FOREIGN PATENT DOCUMENTS

| | | | |
|---|---|---|---|
| CN | 2621472 | Y | 6/2004 |
| CN | 2843147 | Y | 12/2006 |
| CN | 2896981 | | 5/2007 |
| CN | 201001460 | Y | 1/2008 |
| CN | 201001463 | Y | 1/2008 |
| CN | 201076109 | Y | 6/2008 |

(56) References Cited

FOREIGN PATENT DOCUMENTS

| | | |
|---|---|---|
| CN | 201135192 Y | 10/2008 |
| CN | 201197439 Y | 2/2009 |
| CN | 201207982 Y | 3/2009 |
| CN | 201518827 U | 7/2010 |
| DE | 580503 | 7/1933 |
| DE | 2259192 | 6/1974 |
| DE | 3229776 | 4/1983 |
| DE | 3820573 | 8/1989 |
| DE | 297 12 024 | 9/1997 |
| DE | 299 06 116 | 8/1999 |
| DE | 20205561 | 7/2002 |
| DE | 10 2008 034 985 | 2/2010 |
| EP | 0 392 989 | 10/1990 |
| EP | 1 400 186 | 3/2004 |
| EP | 1 700 536 | 9/2006 |
| EP | 2 103 230 | 9/2009 |
| EP | 2 425 738 | 3/2012 |
| GB | 22218 | 9/1911 |
| WO | WO 97/04682 | 2/1997 |
| WO | WO 00/55456 | 9/2000 |
| WO | WO 2005/018369 | 3/2005 |

OTHER PUBLICATIONS

Operation Manual Easy Sun Parasol Sunshade (Issue: Jul. 2004) pp. 1-17.

Treasure Garden's product brochure identified as "AG3 9' Centilever Umbrella", p. 2.

Extended European Search Report issued in European Patent Application No. 14185661.7, dated Feb. 4, 2015, in 8 pages.

Extended European Search Report issued in European Patent Application No. 14155827.0, dated Apr. 29, 2014, in 6 pages.

Extended European Search Report issued in European Patent Application No. 14183987.8, dated Oct. 15, 2014, in 6 pages.

Extended European Search Report issued in European Patent Application No. 14183979.5, dated Oct. 16, 2014, in 6 pages.

Activa Leisure, 2010 Product Catalog.

Treasure Garden, 2010 Product Catalog.

* cited by examiner

UMBRELLA CANOPY TILT MECHANISM

INCORPORATION BY REFERENCE TO ANY PRIORITY APPLICATIONS

Any and all applications for which a foreign or domestic priority claim is identified in the Application Data Sheet as filed with the present application, including Chinese Patent Application No. 201220292694.7, are hereby incorporated by reference under 37 CFR 1.57.

BACKGROUND

Field of the Invention

This application involves the technical aspects of an umbrella, especially the technical aspects of sunshade umbrellas; this application specifically refers to an umbrella with a canopy tilt mechanism in some embodiments.

Description of the Related Art

In the common cantilever umbrellas, the opening/closing of the canopy and angle adjustment are two independent mechanisms. In addition, they are located at different parts or portions of the umbrella in different product designs.

One such example is a Chinese utility model patent (name of patent: Offset Umbrella with Tilt Adjustment, Patent Number: ZL200520102776.0), which uses a rope winding mechanism in an outer casing located at the lower end of the curved pole to achieve the opening and closing of the umbrella, and separately, by pulling at a gin pole located close by and through energy transmission, gears of the connector are disengaged, and only after manually moving the canopy to the desired tilt angle can the gin pole be released to fix the canopy in place.

The second example is another Chinese utility model patent (name of patent: Cantilever Umbrella with Crank Device, Patent Number: ZL200820088054.8), which performs the opening and closing of the canopy with an armrest mechanism fitted on the vertical pole, and a separate rotation mechanism at the lower end of an outer tube is used to adjust the angle of the canopy.

From the cases mentioned above, we can see that the consumer has to perform at least two actions in order to open the canopy and adjust the angle of the canopy. This prior technology can be complicated to operate, and consumes time and effort.

Therefore, there is a need for a simple canopy tilt mechanism which is easy to operate and helps the user to save time and effort.

SUMMARY

Some of the objectives of this invention are to overcome the weaknesses of the prior technology mentioned above by providing a mechanism for adjusting the tilt angle of the canopy. In some embodiments, the canopy tilt mechanism is cleverly designed, structurally simple and easy to operate, and it helps save time and energy and is suitable for large-scale application.

In order to achieve some of the objectives mentioned above, the first aspect of this invention provides an umbrella canopy tilt mechanism, wherein the umbrella canopy tilt mechanism comprises a crank mechanism and an automatic bending mechanism; the crank mechanism can include a crank and a rope; the crank being swivel-mounted on one end of the curved cantilever of a sunshade umbrella; the automatic bending mechanism being installed in the shaft of the sunshade umbrella; one end of the rope being connected to the crank, the other end of the rope passes along the curved cantilever to reach the other end of the curved cantilever and the rope extending through the shaft and through the automatic bending mechanism to connect to the lower runner of the sunshade umbrella; the lower runner is slidably fixed on the shaft; the upper runner of the sunshade umbrella is fixed and secured to the shaft.

Preferably, the shaft includes a first umbrella section and a second umbrella section; the automatic bending mechanism includes a lower end of a first bending section, an upper end of a second bending section, an elastic member, a localization stopper, a first sheave, a second sheave, a curved connecting rod and a directional pulley; the lower end of the first bending section and the upper end of the second bending section being swivel-connected; the first umbrella section being installed above the lower end of the first bending section; the second umbrella section being installed below the bottom of the upper end of the second bending section; the curved connecting rod threaded (or extending) through the lower end of the first bending section and the upper end of the second bending section; the lower end of the first bending section comprising a directional sliding groove; the directional pulley being installed on the curved connecting rod and fitted to and slides on (e.g., moveable along) the directional sliding groove; the second sheave being swivel-installed at the second umbrella section; the localization stopper being located in the second umbrella section and between the upper end of the second bending section and the second sheave and being connected to the curved connecting rod; the first sheave being swivel-mounted at the localization stopper; the elastic member being located in the second umbrella section between the localization stopper and the second sheave, and abuts against (e.g., acting on) the localization stopper and the second umbrella section; the other end of the rope extending along the curved cantilever to reach the other end of the curved cantilever and the rope passing through the shaft and about the first sheave and second sheave and in connection to the lower runner.

More preferably, the automatic bending mechanism further includes a fastening plug, the fastening plug being disposed in the second umbrella section; the second sheave is swivel-mounted to the fastening plug; the elastic member is located between (e.g., being disposed between and contacting) the localization stopper and the fastening plug and thereby abuts against the localization stopper and the fastening plug.

Furthermore, the other end of the rope extends along the curved cantilever to reach the other end of the curved cantilever and is then threaded sequentially through the first umbrella section, the lower end of the first bending section, the upper end of the second bending section, the localization stopper and the elastic member and then around the second sheave, and this is then threaded through the elastic member and around the first sheave and connects to the lower runner after sequentially passing through the elastic member and the fastening plug again.

Furthermore, the fastening plug has a protrusion, the localization stopper has a recess, one end of the elastic member is sleeved on (e.g., disposed over) the protrusion, and the other end of the elastic member is fitted via insertion (e.g., disposed in) to the recess.

Furthermore, the lower end of the first bending section and the upper end of the second bending section are axially connected (e.g., along a transverse axis); the first umbrella section is clamped (e.g., connected) firmly to the lower end of the first bending section; the second umbrella section is clamped firmly to the upper end of the second bending section; the directional pulley is connected to the curved connecting rod through the shaft and the fastening plug is fixed and secured to the second umbrella section; the second sheave is connected to the fastening plug through the shaft; the curved connecting rod is fixed and secured with the localization stopper; the first sheave is connected to the localization stopper through the shaft.

Preferably, the crank mechanism further includes an inclined rod; the inclined rod is installed at one end of the curved cantilever; a crank case is set up on the inclined rod; the crank is swivel-mounted to the crank case.

Preferably, the umbrella canopy tilt mechanism further includes a rotation mechanism; the rotation mechanism includes an outer casing, a handle, a connecting rod and a worm gear assembly; the handle is swivel-mounted at one end of the curved cantilever; the outer casing is installed at the other end of the curved cantilever; the worm gear assembly is installed in the outer casing; one end of the connecting rod is installed on the handle; the other end of the connecting rod extends along the curved cantilever to reach the inside of the outer casing and through the worm gear assembly to connect to the shaft.

Preferably, the worm gear assembly comprises a worm and a worm wheel; the worm is swivel-installed in the outer casing and is connected to the connecting rod; the worm wheel is swivel-installed in the outer casing and engages with the worm; the shaft is connected to the worm wheel.

Furthermore, the rotation mechanism further includes a hinge; the hinge is connected to the worm wheel; the shaft is suspended from the hinge.

Furthermore, the rotation mechanism further includes a shaft sleeve; the shaft sleeve is installed in the outer casing; the worm wheel is fitted via insertion to the shaft sleeve.

More preferably, the connecting rod includes first, second, and third sections; the handle, the first, second, and third sections and the worm gear assembly are all connected through a universal joint.

More preferably, a third sheave is installed in the outer casing; the other end of the rope extends along the curved cantilever to reach the outer casing and winds around the third sheave and then threaded through the shaft and the automatic bending mechanism to connect to the lower runner.

The second aspect of this invention is that it has an umbrella canopy tilt mechanism, wherein the umbrella canopy tilt mechanism comprises a rotation mechanism; the rotation mechanism includes an outer casing, a handle, a connecting rod and a worm gear assembly; the handle is swivel-mounted at one end of the curved cantilever of the sunshade umbrella; the outer casing is installed at the other end of the curved cantilever; the worm gear assembly is installed in the outer casing; one end of the connecting rod is fitted to the handle; the other end of the connecting rod extends along the curved cantilever to reach the outer casing and passes through the worm gear assembly to connect to the shaft of the sunshade umbrella.

Preferably, the worm gear assembly comprises a worm and a worm wheel; the worm is swivel-installed in the outer casing and is connected to the connecting rod; the worm wheel is swivel-installed in the outer casing and engages with the worm; the shaft is connected to the worm wheel.

More preferably, the rotation mechanism further includes a hinge; the hinge and the worm wheel are connected; the shaft is suspended from the hinge.

More preferably, the rotation mechanism further includes a shaft sleeve; the shaft sleeve is installed in the outer casing; the worm wheel is fitted via insertion to the shaft sleeve.

Preferably, the connecting rod includes first, second, and third sections 1; the handle, the first, second, and third sections and the worm gear assembly are all connected through a universal joint.

Preferably, the umbrella canopy tilt mechanism further includes a crank mechanism and an automatic bending mechanism; the rank mechanism includes a crank and a rope; the crank is swivel-mounted at one end of the curved cantilever; the automatic bending mechanism is installed in the shaft; one end of the rope is connected to the crank, the other end of the rope extends along the curved cantilever to reach the other end of the curved cantilever, and is then threaded through the shaft and the automatic bending mechanism to connect to the lower runner of the sunshade umbrella; the lower runner is held to and slides on the shaft; the upper nest of the sunshade umbrella is fixed and secured to the shaft.

More preferably, the shaft includes a first umbrella section and second umbrella section; the automatic bending mechanism includes a lower end of the first bending section, an upper end of the second bending section, an elastic member, a localization stopper, first sheave, second sheave, a curved connecting rod and a directional pulley; the lower end of the first bending section and the upper end of the second bending section are swivel-connected; the first umbrella section is installed on the top of the lower end of the first bending section; the second umbrella section is installed at the bottom of the upper end of the second bending section; the curved connecting rod is threaded through the lower end of the first bending section and the upper end of the second bending section; the lower end of the first bending section is set up with a directional sliding groove; the directional pulley is installed on the curved connecting rod and fitted to and slides on the directional sliding groove; the second sheave is swivel-installed in the second umbrella section; the localization stopper is located in the second umbrella section and between the upper end of the second bending section and the second sheave and is connected to the curved connecting rod; the first sheave is swivel-mounted at the localization stopper; the elastic member is located in the second umbrella section and between the localization stopper and the second sheave and abuts against the localization stopper and the second umbrella section; the other end of the rope extends along the curved cantilever to reach the other end of the curved cantilever, and the rope then passes through the shaft and winds around the first sheave and second sheave of the pulley system based on the principle of halving the pulling force with a labor-saving pulley, and it ends and connects to the lower runner.

Furthermore, the automatic bending mechanism further includes a fastening plug, the fastening plug is installed in the second umbrella section; the second sheave is swivel-mounted to the fastening plug; the elastic member is located between the localization stopper and the fastening plug and thereby abuts against the localization stopper and the fastening plug.

In particular, preferably, the other end of the rope extends along the curved cantilever to reach the other end of the curved cantilever and is then threaded sequentially through the first umbrella section, the lower end of the first bending section, the upper end of the second bending section, the localization stopper and the elastic member and then around the second sheave, and then threaded through the elastic member and around the first sheave, and connects to the lower runner after sequentially passing through the elastic member and the fastening plug again.

In particular, preferably, the fastening plug has a protrusion, the localization stopper has a recess, one end of the elastic member is sleeved on the protrusion, the other end of the elastic member is fitted via insertion to the recess.

In particular, preferably, the lower end of the first bending section and the upper end of the second bending section are axially connected; the first umbrella section is clamped firmly to the lower end of the first bending section; the second umbrella section is clamped firmly to the upper end of the second bending section; the directional pulley is connected to the curved connecting rod through the shaft and the fastening plug is fixed and secured to the second umbrella section; the second sheave is connected to the fastening plug through the shaft; the curved connecting rod is fixed and secured in the localization stopper; the first sheave is connected to the localization stopper through the shaft.

More preferably, the crank mechanism further includes an inclined rod; the inclined rod is installed at one end of the curved cantilever; a crank case is set up on the inclined rod; the crank is swivel-mounted to the crank case.

More preferably, sheave 3 is installed in the outer casing; the other end of the rope extends along the curved cantilever to reach the outer casing and winds around the sheave 3, and is then threaded through the shaft and the automatic bending mechanism to connect to the lower runner of the sunshade umbrella.

Some benefits resulting from this invention are:

1. The canopy tilt mechanism of this invention includes a crank mechanism and an automatic bending mechanism; the crank mechanism consists of a crank and a rope; the crank is swivel-mounted on one end of the curved cantilever of the sunshade umbrella; the automatic bending mechanism is installed in the shaft of the sunshade umbrella; one end of the rope is connected to the crank, the other end of the rope extends along the curved cantilever to reach the other end of the curved cantilever and the rope then passes through the shaft and through the automatic bending mechanism to connect to the lower runner of the sunshade umbrella; the lower runner is held to and slides on the shaft, thus enabling the canopy to be opened by the lifting of the lower runner via the crank; the bending of the shaft is achieved through the automatic bending mechanism by continuously turning the crank, thereby causing the canopy connected to the lower runner to tilt. This mechanism is cleverly designed, structurally simple and easy to operate, it helps save time and energy and is suitable for large-scale application.

2. The canopy tilt mechanism of this invention also includes a rotation mechanism; the rotation mechanism includes an outer casing, a handle, a connecting rod and a worm gear assembly; the crank is swivel-mounted at one end of the curved cantilever; the outer casing is installed at the other end of the curved cantilever; the worm gear assembly is installed in the outer casing; one end of the connecting rod is installed on the handle; the other end of the connecting rod extends along the curved cantilever to reach the inside of the outer casing and through the worm gear assembly to connect to the shaft, thus realizing the rotation of the canopy via the rotation of the handle. Coupled with the tilt described in Point 1, the adjustment of any tilt angle can be achieved to improve its shading effect. This mechanism is cleverly designed, structurally simple and easy to operate, it helps save time and energy and is suitable for large scale application.

DETAILED DESCRIPTION

Figure 1:
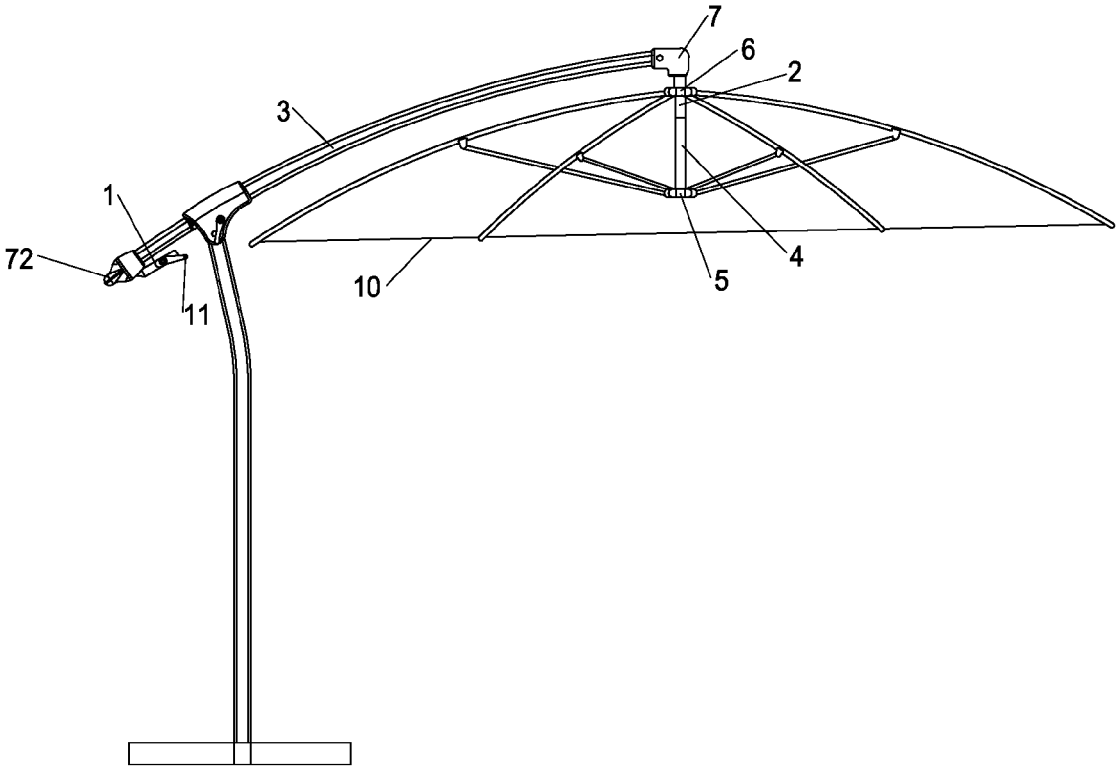
FIG. 1 is a schematic side elevation of an embodiment of a sunshade umbrella.

In order to have a clearer understanding of the technical content of this umbrella canopy tilt mechanism, the following embodiments are specially cited and described in detail. The same reference numerals are used for the same parts.

With reference to FIGS. 1-5, the canopy tilt mechanism of this invention includes a crank mechanism 1 and an automatic bending mechanism 2; the crank mechanism 1 includes a crank 11 and a rope 12 (e.g., cord, cable); the crank 11 is swivel-mounted on one end of the curved cantilever 3 of a sunshade umbrella; the automatic bending mechanism 2 is installed in the shaft 4 of the sunshade umbrella; one end of the rope 12 is connected to the crank 11, the other end of the rope 12 extends along the curved cantilever 3 to reach the other end of the curved cantilever 3 and rope 12 then passes (e.g., extending) through the shaft 4 and through the automatic bending mechanism 2 to connect to the lower runner 5 of the sunshade umbrella; the lower runner 5 is slidably fixed on the shaft 4; the upper runner 6 of the sunshade umbrella is fixed and secured to the shaft 4. For example, a runner that is fixedly secured to a shaft is sometimes known as a hub.

The automatic bending mechanism 2 can take the form of any suitable structure such as described in the Chinese utility model patent ZL00249751.4 (name of utility model: Automatic Bending Mechanism of Sunshade Umbrella) and the Chinese utility model patent ZL03230621.0 (name of utility model: Sunshade Umbrella Bending Mechanism with Improved Structure). With reference to FIGS. 1 and 3-5, in one specific embodiment of this umbrella canopy tilt mechanism, the shaft 4 includes a first umbrella section 41 and a second umbrella section 42; the automatic bending mechanism 2 includes a lower end 21 of the first bending section, an upper end 22 of the second bending section, an elastic member 23, a localization stopper 24, first sheave 25, second sheave 26, a curved connecting rod 27 and a directional pulley 28; the lower end 21 of the first bending section and the upper end 22 of the second bending section are swivel-connected; the first umbrella section 41 is installed on the top of (e.g., above) the lower end 21 of the first bending section; the second umbrella section 42 is installed at the bottom of (e.g., below) the upper end 22 of the second bending section; the curved connecting rod 27 is threaded through the lower end 21 of the first bending section and the upper end 22 of the second bending section; the lower end 21 of the first bending section is set up with a directional sliding groove 29 (e.g., channel); the directional pulley 28 is installed on the curved connecting rod 27 and slidably fixed on the directional sliding groove 29; the second sheave 26 is swivel-installed at the second umbrella section 42; the localization stopper 24 is located in the second umbrella section 42 and between the upper end 22 of the second bending section and the second sheave 26 and is connected to the curved connecting rod 27; the first sheave 25 is swivel-mounted at the localization stopper 24; the elastic member 23 is located in the second umbrella section 42 and between the localization stopper 24 and the second sheave 26, and abuts against the localization stopper 24 and the second umbrella section 42; the other end of the rope 12 extends along the curved cantilever 3 to reach the other end of the curved cantilever 3 and the rope 12 then passes through the shaft 4 and winds around the first sheave 25 and second sheave 26 of the pulley system such that the principle of halving the pulling force with a labor-saving pulley (other methods can certainly be used as well) is achieved, and one end connects to the lower runner 5.

Figure 4:
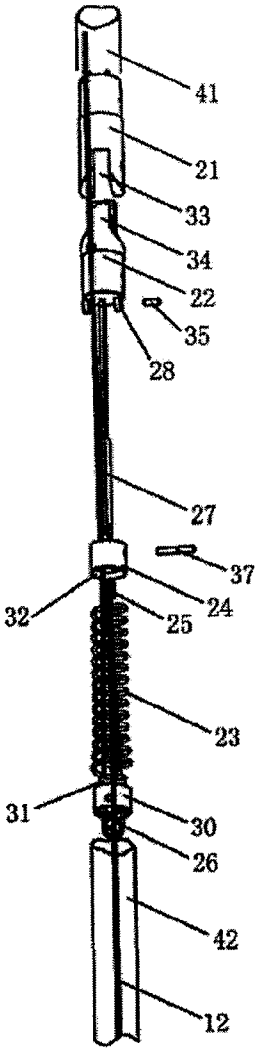
FIG. 4 is a partial exploded view of the structure shown in FIG. 5.
Figure 5:
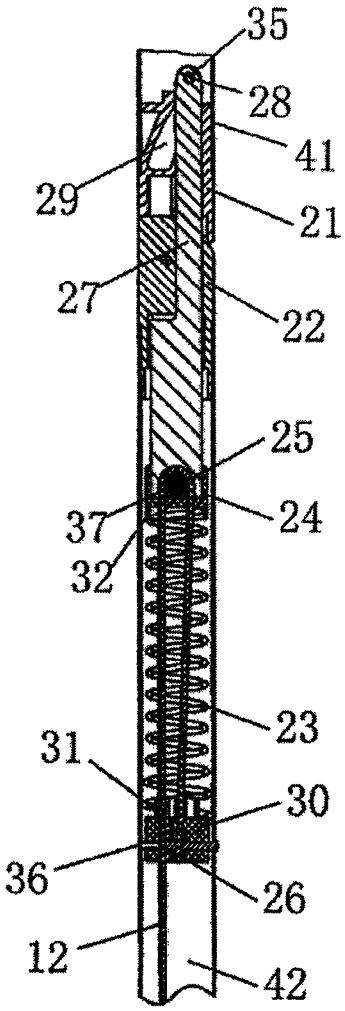
FIG. 5 is a partially enlarged schematic cross sectional view of the sunshade umbrella shown in FIG. 1.

With reference to FIGS. 4-5, in some specific embodiments, the automatic bending mechanism 2 further includes a fastening plug 30, the fastening plug 30 is installed in the second umbrella section 42; the second sheave 26 is swivel-mounted to the fastening plug 30; the elastic member 23 is located between the localization stopper 24 and the fastening plug 30 and thereby abuts against the localization stopper 24 and the fastening plug 30. The localization stopper and fastening plug are examples of mounting members or engagement structures other components (e.g., sheaves, elastic members, springs) are mounted and secured to and/or between.

The winding of the other end of the rope 12 around the pulley system formed by first sheave 25 and second sheave 26 can be accomplished with any suitable winding method. With reference to FIGS. 4-5, in some specific embodiments, the other end of the rope 12 extends along the curved cantilever 3 to reach the other end of the curved cantilever 3 and is then threaded sequentially through the first umbrella section 41, the lower end 21 of the first bending section, the upper end 22 of the second bending section, the localization stopper 24 and the elastic member 23 and then around the second sheave 26, and the rope 12 is then threaded through the elastic member 23 and around the first sheave 25 and then connects to the lower runner 5 after sequentially passing through the elastic member 23 and the fastening plug 30 again.

In order to stabilize the structure, with reference to FIGS. 4-5, in some specific embodiments, the fastening plug 30 has a protrusion 31, the localization stopper 24 has a recess 32, one end of the elastic member 23 is sleeved centered on the protrusion 31, and the other end of the elastic member 23 is fitted via insertion to the recess 32.

Any suitable connection can be used to connect the relevant parts, preferably, the lower end 21 and the upper end 22 of the second bending section are connected by a shaft (e.g. pin, rod, hinge, etc.) the first umbrella section 41 and the lower end 21 of the first bending section are connected with clamps; the second umbrella section 42 and the upper end 22 of the second bending section are connected with clamps; the directional pulley 28 is connected to the curved connecting rod 27 through a shaft and the fastening plug 30 is fixed and secured to the second umbrella section 42; the second sheave 26 is connected to the fastening plug 30 through a shaft; the curved connecting rod 27 is fixed and secured with the localization stopper 24; the first sheave 25 is connected to the localization stopper 24 through a shaft.

With reference to FIGS. 4-5, in some specific embodiments of this, the lower end 21 of the first bending section has grooves 33, the upper end 22 of the second bending section has protrusions (e.g., embedding blocks 34), the embedding blocks 34 are inserted into or received by the recesses (e.g., grooves 33) and axially connected (e.g., at a transverse axis, by an axle, rotatably, pivotably); the first umbrella section 41 is firmly clamped (e.g., coupled to or fixed through a friction fit or other engagement structures) to the lower end 21 of the first bending section with clamps (e.g., friction fit, screws, bolts); the second umbrella section 42 is also firmly clamped to the upper end 22 of the second bending section with clamps; the directional pulley 28 is axially connected (e.g., at a transverse axis, by an axle, rotatably, pivotably) to the curved connecting rod 27 through an elastic cylindrical pin 35; the fastening plug 30 is fixed and attached to the second umbrella section 42 by a rivet 36; the second sheave 26 is sleeved on the rivet 36; the directional connecting rod 27 is fixed and attached to the localization stopper 24 by a cylindrical pin 37; the first sheave 25 is disposed on (e.g., sleeved on) the cylindrical pin 37.

Figure 1A:
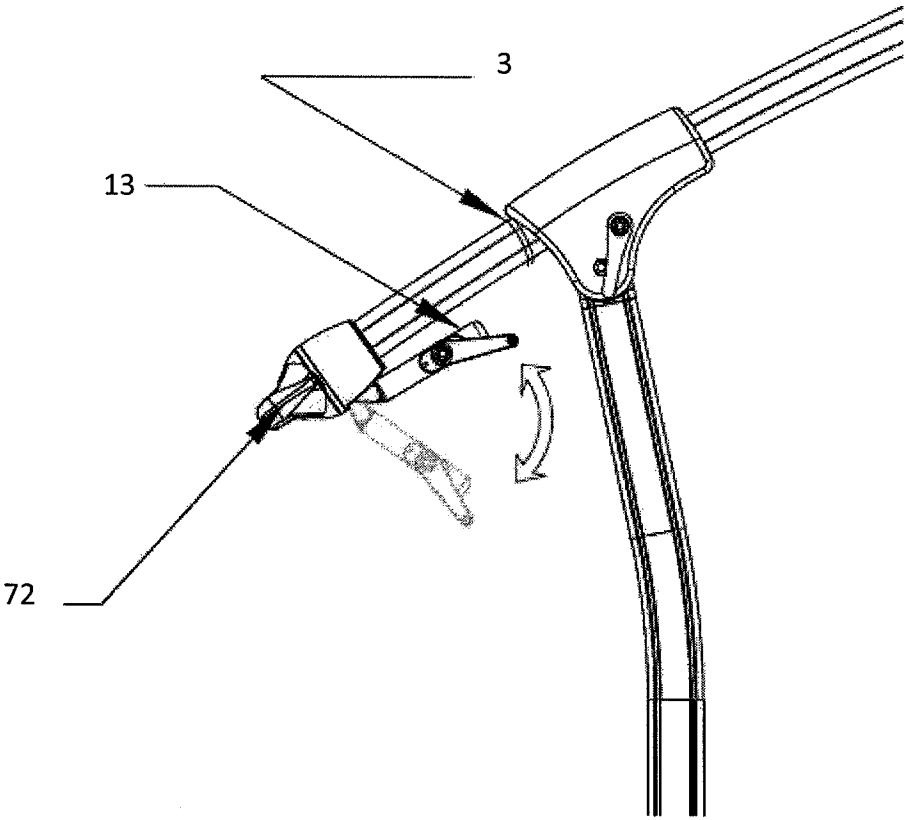
FIG. 1A is a partial detail view of one end of the sunshade umbrella shown in FIG. 1.
Figure 2:
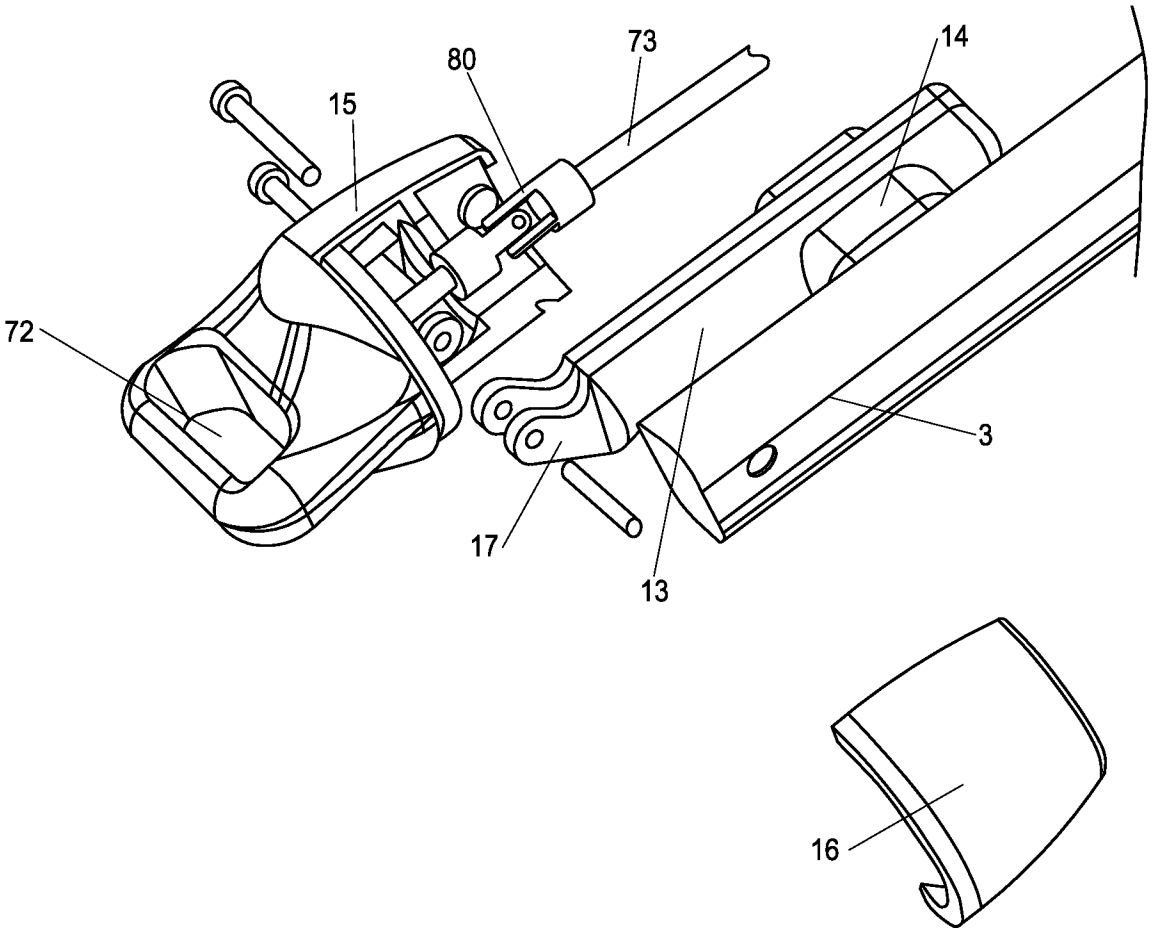
FIG. 2 is a partially enlarged and exploded schematic diagram 1 of the sunshade umbrella shown in FIG. 1.

The crank mechanism 1 can be of any suitable structure; preferably, the crank mechanism 1 further includes an inclined rod 13; the inclined rod 13 is installed at one end of the curved cantilever 3; a crank case 14 is set up on the inclined rod 13; the crank 11 is swivel-mounted to the crank case 14. With reference to FIGS. 1-2, in some specific embodiments, first outer shell 15 and second outer shell 16 are fastened together and installed at one end of the curved cantilever 3; the inclined rod 13 is axially connected (e.g., at a transverse axis, by an axle, rotatably, pivotably) to first outer shell 15 and second outer shell 16 through a rod connector 17. The inclined rod 13 is able to rotate about the curved cantilever 3 when exerted on with some external force, for example, between a first position adjacent to the curved cantilever 3 and a second position away from the curved cantilever 3 in the direction of the arrow as illustrated in FIG. 1A. Crank 11 need not be installed on the outside, it can also be installed directly at one end of the curved cantilever 3. The umbrella canopy tilt mechanism is designed in such a way that if the height required to open the canopy 10 is too high, by installing the crank 11 at a low position, the crank 11 can first be lowered and turned again to reduce accordingly the height required to open the umbrella.

Figure 3:
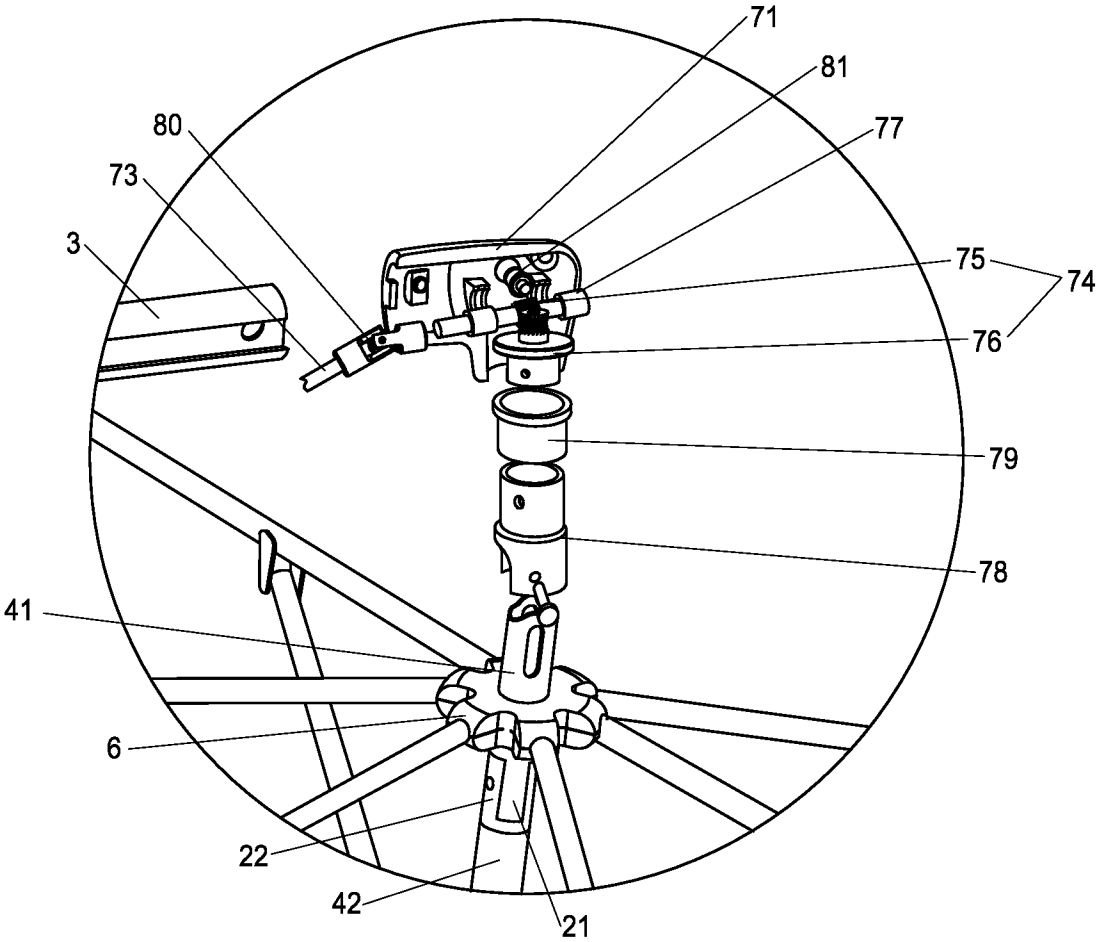
FIG. 3 is a partially enlarged and exploded schematic diagram 2 of the sunshade umbrella shown in FIG. 1.

In order to be able to adjust the canopy to any angle, preferably, the umbrella canopy tilt mechanism further includes a rotation mechanism 7; the rotation mechanism 7 includes an outer casing 71, a handle 72, a connecting rod 73 and a worm gear assembly 74; the handle 72 is swivel-mounted at one end of the curved cantilever 3; the outer casing 71 is installed at the other end of the curved cantilever 3; the worm gear assembly 74 is installed in the outer casing 71; one end of the connecting rod 73 is fitted to the handle 72; the other end of the connecting rod 73 extends along the curved cantilever to reach the inside of the outer casing 71 and through the worm gear assembly 74 to connect to the shaft 4. With reference to FIGS. 1 and 3, in the specific embodiment of this utility model, the handle 72 is swivel-installed to first outer casing 15 and second outer casing 16; the outer casing 71 can similarly be made up by coupling two parts or casings together.

The worm gear assembly 74 can be of any suitable structure; with reference to FIGS. 1 and 3, in the specific embodiment of this utility model, the worm gear assembly 74 comprises a worm 75 and a worm wheel 76; the worm 75 is swivel-installed in the outer casing 71 and is connected to the connecting rod 73; the worm wheel 76 is swivel-installed in the outer casing 71 and engages with the worm 75; the shaft 4 is connected to the worm wheel 76. Specifically, worm 75 can be located on the outer shell 71 via the bearings 77 and the first umbrella section 41 is connected to the worm wheel 76.

With reference to FIGS. 1 and 3, in a specific embodiment of this umbrella canopy tilt mechanism, the rotation mechanism 7 further includes a hinge 78 (e.g., rod, pin, axles, shaft); the hinge 78 is connected to the worm wheel 76; the shaft 4 is suspended from the hinge 78. Specifically, the hinge 78 and the worm wheel 76 are fastened together with a screw or bolt; the first umbrella section 41 is suspended from the hinge 78 by means of a bolt.

With reference to the FIGS. 1 and 3, in some specific embodiments, the rotation mechanism 7 further includes a shaft sleeve 79; the shaft sleeve 79 is installed in the outer casing 71; the worm wheel 76 is fitted via insertion to the shaft sleeve 79.

With reference to FIGS. 1 and 3, in some specific embodiments, the connecting rod 73 includes first, second, and third sections; the handle 72, the first, second, and third sections of the connecting rod 73 and the worm gear assembly 74 are all connected through a universal joint 80.

For ease of operation, with reference to FIGS. 1 and 3, in specific embodiments, third sheave 81 is installed in the outer casing 71; the other end of the rope 12 extends along the curved cantilever 3 to reach the outer casing 71 and winds around the third sheave 81, and is then threaded through the shaft 4 and the automatic bending mechanism 2 to connect to the lower runner 5 of the sunshade umbrella.

Figure 6:
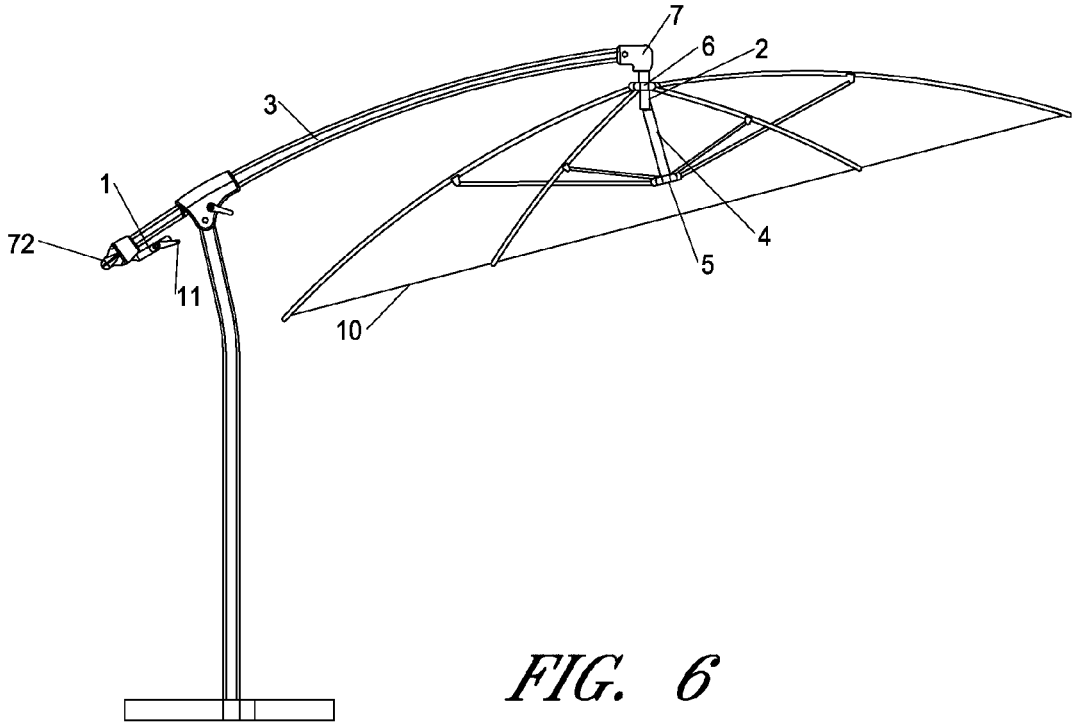
FIG. 6 is a schematic side elevation of the sunshade umbrella shown in FIG. 1 with its canopy tilted backwards.
Figure 7:
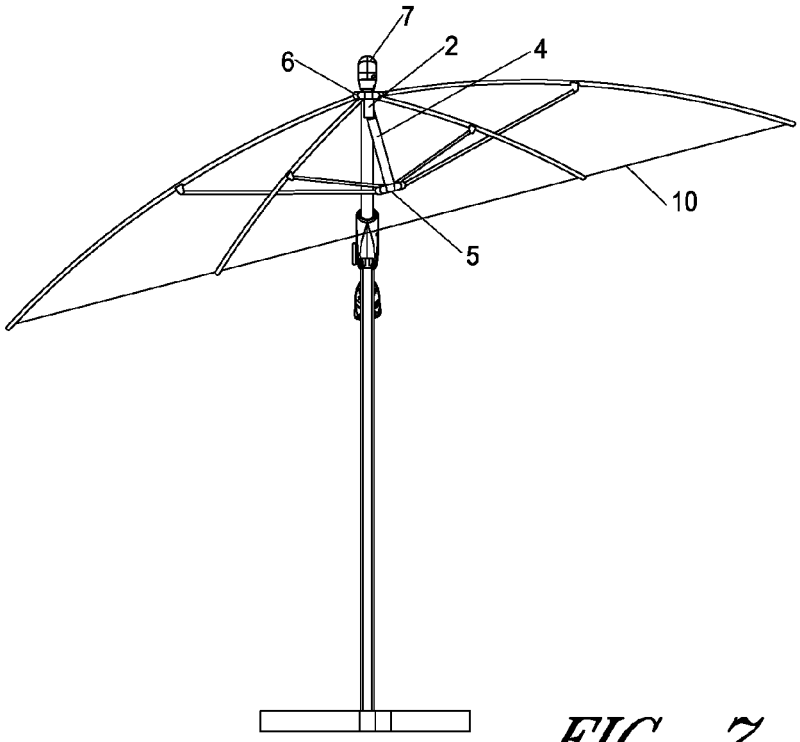
FIG. 7 is a schematic front view of the sunshade umbrella shown in FIG. 1 with its canopy tilted to the left.
Figure 8:
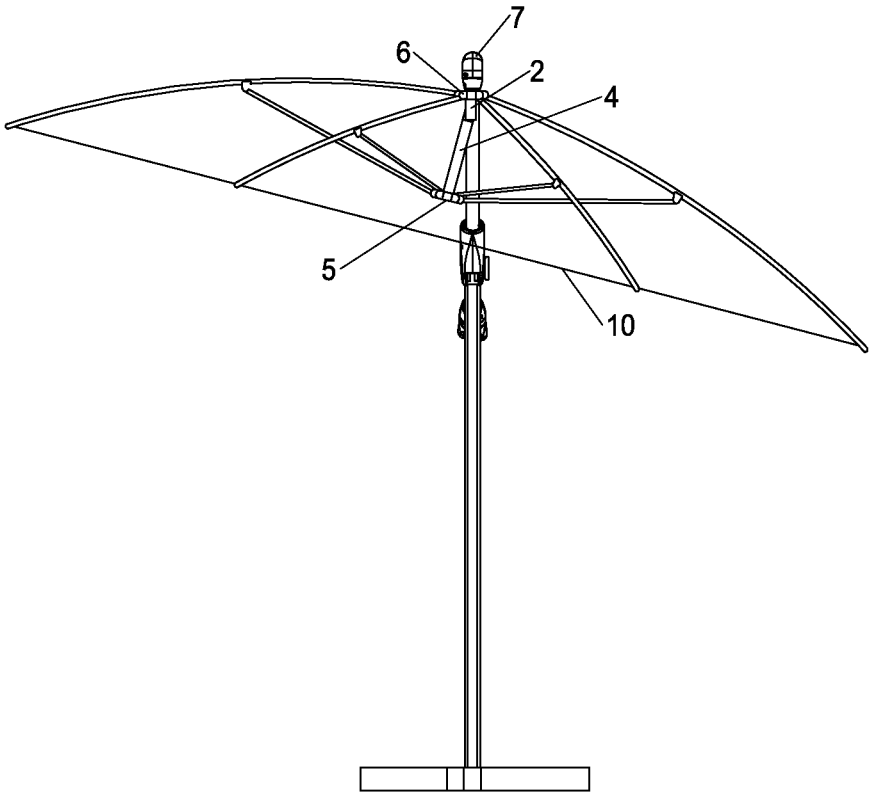
FIG. 8 is a schematic front view of the sunshade umbrella shown in FIG. 1 with its canopy tilted to the right.

When using this umbrella canopy tilt mechanism, first jolt (e.g., turn, rotate) the crank 11 to furl in (e.g., wind, retract) rope 12 and cause the lower runner 5 to be lifted by the pulling action, and the opening of the canopy is realized as illustrated in FIG. 1; continue turning the crank 11, as the shaft 4 is equipped with an automatic bending mechanism 2, by the principle and components of the automatic bending mechanism, the directional pulley 28 will start to turn in the directional sliding groove 29 when the curved connecting rod 27 is pulled or moved down, and this will then cause first umbrella section 41 and second umbrella section 42 to bend into a certain angle, thus causing the lower runner 5 and the canopy 10 connected to the lower runner 5 to swing to a certain angle. The tilting of the canopy 10 in the fore and aft direction is then realized as illustrated in FIG. 6. The worm wheel 76 is able to rotate around an axis, and the worm 75 and worm wheel 76 combine to form a kinematic pair; by turning the handle 72, the connecting rod 73 will drive worm 75 to rotate and worm 75 will in turn drive worm wheel 76 to rotate, which causes shaft 4 to rotate around its own axis; when shaft 4 drives the umbrella frame to rotate to the right on its axis, the back tilt of the canopy 10 will become a left tilt as illustrated in FIG. 7 and it will become a right tilt when it is rotated in the opposite direction as illustrated in FIG. 8.

This umbrella canopy tilt mechanism includes a crank mechanism 1, a rotation mechanism 7 and an automatic bending mechanism 2; the crank mechanism 1 and the automatic bending mechanism 2 are used for opening/closing canopy 10 and for adjusting the tilt angle of canopy 10; the rotation mechanism 7 is used for rotating canopy 10. Combining the crank and rotation mechanisms in a single device is a new concept and the mechanisms are appropriate. By turning crank 11 behind canopy 10 repeatedly to open the canopy, canopy 10 can be tilted to a certain angle with the automatic bending mechanism 2; if the canopy 10 is tilted in the fore and aft direction at this particular moment, handle 72 can be used to tilt the canopy 10 in the left or right direction. Through the application of this device, the angle of the rotatable cantilever umbrella can be adjusted from front to back, left to right to obtain an appropriate shade angle and thus enhance the shading effects of the umbrella. Furthermore, this device has the features of being structurally simple, beautiful and simple in appearance, and easy to operate etc.

In summary, the canopy tilt mechanism is cleverly designed, structurally simple, easy to operate, and it helps save time and energy and is suitable for large-scale application.

In this application, the umbrella canopy tilt mechanism is described with reference to specific embodiments. However, it is obvious that modifications and variations can still be made to the inventions without departing from its essence and scope. Therefore, this specifications and drawings should be considered as descriptive rather than restrictive.

What is claimed is:

1. An umbrella canopy tilt mechanism comprising:

a crank mechanism and an automatic bending mechanism, the crank mechanism comprising a crank and a rope;

wherein the crank is mounted on one end of a cantilever of a sunshade umbrella; wherein the automatic bending mechanism is installed in a shaft of the sunshade umbrella; one end of the rope is connected to the crank and the other end of the rope extends along the cantilever to reach the other end of the cantilever, the rope extends from the cantilever and has a first section disposed through the shaft, a second section disposed through a first bending section, and a third section disposed through a second bending section of the automatic bending mechanism to connect to a lower runner of the sunshade umbrella; wherein applying tension on the rope initially opens the sunshade umbrella and applying further tension on the rope when the sunshade umbrella is in an open position results in pivoting of the second bending section relative to the first bending section from a first open position of the sunshade umbrella to a second open position of the sunshade umbrella; the lower runner is held and slides on the shaft; and an upper runner of the sunshade umbrella is fixedly secured to the shaft, the automatic bending mechanism being disposed in the shaft between the upper runner and the lower runner.

2. The umbrella canopy tilt mechanism as claimed in claim 1, wherein the shaft comprises a first umbrella section and a second umbrella section;

the automatic bending mechanism comprises a lower end of the first bending section, an upper end of the second bending section, an elastic member, a localization stopper, first sheave, second sheave, a curved connecting rod and a directional pulley, the lower end of the first bending section and the upper end of the second bending section being swivel-connected; the first umbrella section being installed above the lower end of the first bending section, the second umbrella section being installed below the upper end of the second bending section; the curved connecting rod extending through the lower end of the first bending section and the upper end of the second bending section; the lower end of the first bending section comprising a directional sliding groove, the directional pulley being installed on the curved connecting rod and moveable along the directional sliding groove;

the second sheave is swivel-mounted on the second umbrella section; the localization stopper being located in the second umbrella section and between the upper end of the second bending section and the second sheave and being connected to the curved connecting rod; the first sheave being swivel-mounted at the localization stopper;

the elastic member being located in the second umbrella section between the localization stopper and the second sheave and acting on the localization stopper and the second umbrella section; the other end of the rope extending along the cantilever to reach the other end of the cantilever, the rope passing through the shaft and about the first sheave and second sheave and in connection to the lower runner.

3. The umbrella canopy tilt mechanism as claimed in claim 2, wherein the automatic bending mechanism further includes a fastening plug, the fastening plug being disposed in the second umbrella section; the second sheave being swivel-mounted to the fastening plug; the elastic member being disposed between and contacting the localization stopper and the fastening plug.

4. The umbrella canopy tilt mechanism as claimed in claim 3, wherein the cantilever is curved, the other end of the rope extends along the curved cantilever to reach the other end of the curved cantilever and is then threaded sequentially through the first umbrella section, the lower end of the first bending section, the upper end of the second bending section, the localization stopper and the elastic member and then around the second sheave, and is then threaded through the elastic member and around the first sheave and connects to the lower runner after sequentially passing through the elastic member and the fastening plug again.

5. The umbrella canopy tilt mechanism as claimed in claim 3, wherein the fastening plug has a protrusion, the localization stopper has a recess, one end of the elastic member is disposed over the protrusion, the other end of the elastic member is disposed in the recess.

6. The umbrella canopy tilt mechanism as claimed in claim 3, wherein the lower end of the first bending section and the upper end of the second bending section are connected along a transverse axis; the first umbrella section is connected to the lower end of the first bending section; the second umbrella section is connected to the upper end of the second bending section; the directional pulley is rotatably connected to the curved connecting rod and the fastening plug is fixed and secured to the second umbrella section; the second sheave is connected to the fastening plug; the curved connecting rod is coupled with the localization stopper; the first sheave is coupled with the localization stopper.

7. The umbrella canopy tilt mechanism as claimed in claim 1, wherein the crank mechanism further includes an inclined rod disposed at one end of the cantilever; a crank case disposed on the inclined rod, the crank being swivel-mounted to the crank case.

8. The umbrella canopy tilt mechanism as claimed in claim 1, further comprising a rotation mechanism comprising an outer casing, a handle, a connecting rod and a gear assembly; the crank being swivel-mounted at one end of the cantilever; the outer casing being disposed at the other end of the cantilever; the gear assembly being installed in the outer casing; one end of the connecting rod being coupled with the handle; the other end of the connecting rod extending along the cantilever to reach the inside of the outer casing and through the gear assembly to be coupled with the shaft.

9. The umbrella canopy tilt mechanism as claimed in claim 8, wherein the gear assembly comprises a worm and a worm wheel; the worm being swivel-mounted in the outer casing and being connected to the connecting rod; the worm wheel being swivel-mounted in the outer casing and coupled with the worm; the shaft being coupled with the worm wheel.

10. The umbrella canopy tilt mechanism as claimed in claim 9, wherein the rotation mechanism further includes a hinge coupled with the worm wheel; wherein the shaft is suspended from the hinge.

11. The umbrella canopy tilt mechanism as claimed in claim 9, wherein the rotation mechanism further includes a shaft sleeve disposed in the outer casing; the worm wheel being received in the shaft sleeve.

12. The umbrella canopy tilt mechanism as claimed in claim 8, wherein the connecting rod comprises a plurality of sections; the handle, the sections and the gear assembly being coupled together with universal joints.

13. The umbrella canopy tilt mechanism as claimed in claim 8, wherein a third sheave is disposed in the outer casing; an end of the rope extends along the cantilever to the outer casing and winds around the sheave and through the shaft and the automatic bending mechanism to connect to the lower runner.

14. An umbrella canopy tilt mechanism, comprising:

a rotation mechanism; the rotation mechanism including an outer casing, a handle, a connecting rod and a gear assembly; the handle being rotatably mounted at one end of a cantilever of the sunshade umbrella; the handle comprising a user graspable grip having an axis of rotation, that is aligned with a longitudinal axis of the cantilever; the outer casing being installed at the other end of the cantilever; the gear assembly installed in the outer casing;

one end of the connecting rod being fitted to the handle; and the other end of the connecting rod extending along the cantilever to reach the outer casing and acting on a shaft assembly of the sunshade umbrella through the gear assembly to rotate a canopy of the umbrella.

15. The umbrella canopy tilt mechanism as claimed in claim 14, wherein the cantilever is curved and the gear assembly comprises a worm and a worm wheel; the worm being swivel-installed in the outer casing and being connected to the connecting rod; the worm wheel being swivel-installed in the outer casing and engaging with the worm; the shaft assembly being coupled with the worm wheel.

16. The umbrella canopy tilt mechanism as claimed in claim 15, wherein the rotation mechanism further includes a hinge coupled with the worm wheel; the shaft assembly being suspended from the hinge.

17. The umbrella canopy tilt mechanism as claimed in claim 15, wherein the rotation mechanism further comprises a shaft sleeve disposed in the outer casing, the worm wheel being fitted via insertion to the shaft sleeve.

18. The umbrella canopy tilt mechanism as claimed in claim 14, wherein the connecting rod includes a plurality of sections; the handle, the plurality of sections of the connecting rod, and the gear assembly being connected through universal joints.

19. The umbrella canopy tilt mechanism as claimed in claim 14, wherein the umbrella canopy tilt mechanism further comprises a crank mechanism and an automatic bending mechanism;

the crank mechanism includes a crank and a rope; the crank being swivel-mounted at one end of the cantilever; the automatic bending mechanism being installed in the shaft assembly;

one end of the rope being connected to the crank, the other end of the rope extending along the cantilever to reach the other end of the cantilever and being threaded through the shaft assembly and the automatic bending mechanism to connect to a lower runner of the sunshade umbrella;

the lower runner being held and sliding on the shaft assembly; an upper runner of the sunshade umbrella being secured to the shaft assembly.

20. The umbrella canopy tilt mechanism as claimed in claim 19, wherein the shaft assembly comprises a first umbrella section and a second umbrella section;

the automatic bending mechanism including a lower end of a first bending section, an upper end of a second bending section, an elastic member, a localization stopper, first sheave, second sheave, a curved connecting rod and a directional pulley; the lower end of the first bending section and the upper end of the second bending section are swivel-connected; the first umbrella section being installed above the lower end of the first bending section; the second umbrella section being installed below the bottom of the upper end of the second bending section; the curved connecting rod is threaded through the lower end of the first bending section and the upper end of the second bending section; the lower end of the first bending section includes a directional sliding groove; the directional pulley is disposed on the curved connecting rod and moveable on the directional sliding groove; the second sheave being swivel-installed in the second umbrella section; the localization stopper being located in the second umbrella section and between the upper end of the second bending section and the second sheave and is connected to the curved connecting rod; the first sheave being swivel-mounted on the localization stopper; the elastic member being located in the second umbrella section and between the localization stopper and the second sheave and acting on the localization stopper and the second umbrella section; the other end of the rope extends along the cantilever to reach the other end of the cantilever and the rope passing through the shaft assembly and about the first sheave and second sheave and in connection to the lower runner.

21. The umbrella canopy tilt mechanism as claimed in claim 20, wherein the automatic bending mechanism further comprises a fastening plug, the fastening plug being installed in the second umbrella section; the second sheave is swivel-mounted to the fastening plug; the elastic member is located between the localization stopper and the fastening plug.

22. The umbrella canopy tilt mechanism as claimed in claim 21, wherein the other end of the rope extends along the cantilever to reach the other end of the cantilever and is then threaded sequentially through the first umbrella section, the lower end of the first bending section, the upper end of the second bending section, the localization stopper and the elastic member and then around the second sheave, and is then threaded through the elastic member and around the first sheave and connects to the lower runner after sequentially passing through the elastic member and the fastening plug again.

23. The umbrella canopy tilt mechanism as claimed in claim 21, wherein the fastening plug has a protrusion, the localization stopper has a recess, one end of the elastic member is sleeved on the protrusion, the other end of the elastic member is fitted via insertion to the recess.

24. The umbrella canopy tilt mechanism as claimed in claim 21, wherein the lower end of the first bending section and the upper end of the second bending section are connected with a rotatable connection; the first umbrella section and the lower end of the first bending section are connected through clamping; the second umbrella section is clamped to the upper end of the second bending section; the directional pulley is axially connected to the curved connecting rod and the fastening plug is fixed and secured to the second umbrella section; the curved connecting rod is fixed and secured inside a portion of the localization stopper; and the first sheave is connected to the localization stopper.

25. The umbrella canopy tilt mechanism as claimed in claim 19, wherein the crank mechanism further includes an inclined rod; the inclined rod being installed at one end of the cantilever; a crank case is set up on the inclined rod; the crank is swivel-mounted to the crank case.

26. The umbrella canopy tilt mechanism as claimed in claim 19, wherein a third sheave is installed in the outer casing; the other end of the rope extends along the cantilever to reach the outer casing and winds around the third sheave and is then threaded through the shaft assembly and the automatic bending mechanism to connect to the lower runner of the sunshade umbrella.

27. An umbrella assembly comprising:

a crank mechanism, the crank mechanism comprising a crank and a tension member;

a canopy assembly comprising a shaft assembly, a lower runner and an upper runner, the lower runner slidable on the shaft assembly to open and close the umbrella and the upper runner being coupled to the shaft assembly;

a rotation mechanism comprising an outer casing, a handle, a connecting rod and a gear assembly;

wherein the crank is rotatably mounted on a cantilever of the umbrella adjacent to one end of the cantilever of the umbrella, an axis of rotation of the crank being movable away from the cantilever to a cranking position without changing the position of the cantilever; one end of the tension member being connected to the crank and the other end of the tension member extending along the cantilever to reach the other end of the cantilever, the tension member extending through the shaft assembly to connect to the lower runner such that rotation of the crank tilts the lower runner of the canopy assembly relative to the upper runner; the outer casing being disposed at an opposite end of the cantilever from the crank; the handle mounted at a terminal end of the cantilever; the gear assembly being installed in the outer casing; and one end of the connecting rod being coupled with the handle, the other end of the connecting rod extending through the cantilever to the gear assembly to be coupled with the shaft.

28. The umbrella canopy tilt mechanism of claim 27 further comprising an automatic bending mechanism disposed in the shaft assembly between the upper runner and the lower runner.

29. The umbrella assembly of claim 27 wherein the crank is rotatably swivel-mounted on the cantilever of the umbrella.

30. An umbrella canopy mechanism, comprising:

an outer casing, a handle, a connecting rod and a gear assembly; the handle comprising an axis of rotation and being rotatably mounted at a terminal end of a cantilever of an umbrella, the axis of rotation being aligned with a longitudinal axis of the cantilever; the outer casing being installed at the other end of the cantilever; the gear assembly being disposed in the outer casing; one end of the connecting rod being coupled to a user-grippable portion of the handle with a universal joint;

the connecting rod extending along the cantilever such that another end thereof is disposed in the outer casing and acts on an upper portion of a shaft assembly of the umbrella through the gear assembly.

31. An umbrella assembly comprising:

an upright pole;

a cantilevered beam having a first end disposed away from the upright pole and a second end disposed adjacent to the upright pole;

a shaft assembly coupled to the first end of the cantilevered beam;

a canopy frame coupled to the shaft assembly, the canopy frame comprising an upper runner coupled with the shaft assembly and a lower runner coupled with the shaft assembly;

a crank mechanism comprising a crank and a tension member, the crank mounted on the second end of the cantilevered beam; and an automatic bending mechanism installed in a shaft of the shaft assembly of the umbrella, the automatic bending mechanism comprising a first bending section and a second bending section;

wherein one end of the tension member is connected to the crank and the other end of the tension member extends along the cantilevered beam and extends from the cantilevered beam and has a first section disposed through the shaft, a second section disposed through a first bending section, and a third section disposed through a second bending section of the automatic bending mechanism to connect to the lower runner such that rotation of the crank applies tension to the tension member to slide the lower runner along the shaft and to pivot the second bending section with respect to the first bending section upon activation of the tension member on the second bending section from above the canopy frame, wherein an axis of pivoting is disposed between the upper runner and the lower runner when the second bending section is pivoted relative to the first bending section;

wherein initial rotation of the crank opens the canopy and further rotation of the crank operates the automatic bending mechanism.

32. The umbrella assembly of claim 31 further comprising a rotation mechanism comprising a handle mounted at a terminal end of the cantilevered beam, a connecting rod, and a gear assembly.

33. An umbrella assembly comprising:

an upright pole;

a cantilevered beam having a first end disposed away from the upright pole and a second end disposed adjacent to the upright pole;

a canopy frame coupled to a shaft assembly, the shaft assembly coupled to the first end of the cantilevered beam, the canopy frame comprising an upper runner coupled with the shaft assembly and a lower runner coupled with the shaft assembly;

a crank mechanism comprising a crank and a tension member, the crank mounted on a free end of a swivel arm, a second end of the swivel arm pivotably coupled with the second end of the cantilevered beam such that the crank can rotate between a stowed position and an extended position, the crank being pivoted towards the cantilevered beam in the stowed position such that the free end of the swivel arm is adjacent to the cantilever beam, and the crank being pivoted away from the cantilevered beam and the free end of the swivel arm being extended from the cantilevered beam in the extended position, wherein in the stowed position the free end of the swivel arm and the crank are above a handle rotatably mounted to the second end of the cantilever beam.

34. The umbrella assembly of claim 33 further comprising an automatic bending mechanism installed in the shaft assembly of the umbrella, wherein one end of the tension member is connected to the crank and the other end of the rope extends along the cantilevered beam and through the shaft assembly and the automatic bending mechanism to the lower runner.

35. The umbrella assembly of claim 33 further comprising a tilt mechanism comprising the handle rotatably mounted to the second end of the cantilevered beam.

* * * * *